US009620316B2

(12) United States Patent
Gentsch et al.

(10) Patent No.: US 9,620,316 B2
(45) Date of Patent: Apr. 11, 2017

(54) CIRCUIT-BREAKER POLE PART WITH A FLEXIBLE CONDUCTOR FOR CONNECTING A MOVABLE ELECTRICAL CONTACT

(71) Applicant: ABB Technology AG, Zürich (CH)

(72) Inventors: Dietmar Gentsch, Ratingen (DE); Manfred Sauer, Ratingen (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/137,685

(22) Filed: Dec. 20, 2013

(65) Prior Publication Data

US 2014/0175058 A1 Jun. 26, 2014

(30) Foreign Application Priority Data

Dec. 20, 2012 (EP) ..... 12008485

(51) Int. Cl.

| | |
|---|---|
| ***H01H 33/664*** | (2006.01) |
| ***H01H 33/66*** | (2006.01) |
| ***H01H 33/666*** | (2006.01) |
| ***H01H 1/58*** | (2006.01) |

(52) U.S. Cl.

CPC ..... *H01H 33/664* (2013.01); *H01H 1/5822* (2013.01); *H01H 33/6606* (2013.01); *H01H 33/666* (2013.01)

(58) Field of Classification Search

CPC .. H01H 33/66; H01H 33/6606; H01H 33/664; H01H 2033/6613; H01H 9/34; H01H 1/5822

USPC ..... 218/121, 123, 124, 134, 139, 140

See application file for complete search history.

(56) References Cited

U.S. PATENT DOCUMENTS

| | | | | |
|---|---|---|---|---|
| 2,897,322 | A * | 7/1959 | Reece | 218/10 |
| 3,594,525 | A * | 7/1971 | Miller | H01H 33/008 200/337 |
| 5,486,662 | A * | 1/1996 | Takiishi | 200/50.27 |
| 6,410,875 | B2 * | 6/2002 | Allard et al. | 218/118 |
| 2009/0218319 | A1 * | 9/2009 | Kagawa | 218/140 |

(Continued)

FOREIGN PATENT DOCUMENTS

EP 2 063 442 A1 5/2009

OTHER PUBLICATIONS

European Search Report for EP 12008485 dated Jun. 25, 2013.

*Primary Examiner* — R S Luebke
*Assistant Examiner* — William Bolton
(74) *Attorney, Agent, or Firm* — Taft Stettinius & Hollister LLP

(57) ABSTRACT

The disclosure relates to a pole part of a circuit-breaker arrangement having an insulation housing for accommodating a vacuum interrupter containing a pair of corresponding electrical switching contacts, wherein a fixed upper electrical contact is connected to an upper electrical terminal molded or assembled in the insulation housing and a movable lower electrical contact is connected to the insulating housing by a support plate of the insulation housing via a flexible conductor that includes a first end for attaching the flexible conductor to the lower electrical terminal and a second end for attaching the flexible conductor to the movable lower electrical contact. The second end of the flexible conductor is provided with an inside thread which is screwed to an outside thread arranged on the distal end of the movable lower electrical contact.

3 Claims, 3 Drawing Sheets

(56) References Cited

U.S. PATENT DOCUMENTS

| | | | | |
|---|---|---|---|---|
| 2010/0059480 | A1* | 3/2010 | Sasaki et al. | 218/140 |
| 2010/0307901 | A1* | 12/2010 | Maruyama et al. | 200/337 |
| 2011/0253675 | A1* | 10/2011 | Heller et al. | 218/5 |
| 2013/0126479 | A1* | 5/2013 | Shang | 218/120 |

* cited by examiner

CIRCUIT-BREAKER POLE PART WITH A FLEXIBLE CONDUCTOR FOR CONNECTING A MOVABLE ELECTRICAL CONTACT

RELATED APPLICATION(S)

This application is a continuation under 35 U.S.C. §119 to European application EP 12008485.0 filed in Europe on Dec. 20, 2012, the entire content of which are hereby incorporated by reference.

FIELD

The disclosure relates to a pole part of a circuit-breaker arrangement, and particularly a pole-part of a circuit-breaker arrangement including an insulation housing for accommodating a vacuum interrupter insert containing a pair of corresponding electrical contacts.

BACKGROUND INFORMATION

Known circuit-breaker pole parts can be integrated in medium-voltage to high voltage circuit-breaker arrangement. Especially, medium-voltage circuit-breakers are rated between 1 and 72 kV of a high current level. These specific breakers interrupt the current by creating and extinguishing the arc in a vacuum container. Inside the vacuum container a pair of corresponding electrical switching contacts is accommodated. Modern vacuum circuit-breakers tend to have a longer life expectancy than former air circuit-breakers. Although, vacuum circuit-breakers replace air circuit-breakers, the present disclosure is not only applicable to vacuum circuit-breakers but also for air circuit-breakers or modern SF6 circuit-breakers having, a chamber filled with sulfur hexafluoride gas instead of vacuum.

For actuating a circuit-breaker, a magnetic or a spring actuator with a high force density is used which moves one of the electrical contacts of a vacuum interrupter for a purpose of electrical power interruption. Therefore, a mechanical connection between a movable armature of a spring or magnetic actuator and an axially movable electrical contact inside the vacuum interrupter is provided.

The document EP 2 063 442 A1 discloses a circuit-breaker pole part including a pair of corresponding electrical switching contacts which are partly accommodated inside a interrupter filled with sulfur hexafluoride gas for high voltage applications above 52 kV of a high current above 10 kA.

According to known implementations, it is also possible to attach a flexible conductor of the kind as described above by screwing elements. In this case the flexible conductor is pressed against the movable electrical contact and the electrical terminal respectively with the at least one screwing element, e.g. screw or nut. Therefore, at least one through hole is provided at the ends of the flexible conductor for respective screwing elements. Flexible conductors are usually used for lower nominal currents and by treated parts; multi-contacts are usually used for higher nominal currents.

The thickness of the flexible conductor grows by increasing the nominal current. In consequence, for high nominal currents a flexible conductor cannot be used, since the diameter of the movable electrical contact can be too small for attaching the flexible conductor to the outer surface of the movable electrical contact which is arranged outside the interrupter.

SUMMARY

An exemplary pole part of a circuit-breaker arrangement is disclosed, comprising: an insulation housing for accommodating a vacuum interrupter having a pair of corresponding electrical switching contacts, wherein a fixed upper electrical contact is connected to an upper electrical terminal molded or assembled in the insulation housing and a movable lower electrical contact is connected to an electrical contact element of the insulation housing via a flexible conductor including a first end for attaching the flexible conductor to the insulation housing and a second end for attaching the flexible conductor to the movable lower electrical contact, wherein the second end of the flexible conductor has an inside thread which is screwed to an outside thread arranged on a distal end of the movable lower electrical contact.

An exemplary circuit-breaker arrangement for medium-voltage applications is disclosed, comprising: a magnetic or spring driven actuator for generating an operation force, transmitted via a jackshaft arrangement to at least one vacuum interrupter having a pair of corresponding electrical switching contacts, wherein a fixed upper electrical contact is connected to an upper electrical terminal molded or assembled in the insulation housing and a movable lower electrical contact is connected to an electrical contact element of the insulation housing via a flexible conductor including a first end for attaching the flexible conductor to the insulation housing and a second end for attaching the flexible conductor to the movable lower electrical contact, wherein the second end of the flexible conductor has an inside thread which is screwed to an outside thread arranged on a distal end of the movable lower electrical contact.

BRIEF DESCRIPTION OF THE DRAWINGS

The foregoing and other aspects of the disclosure will become apparent following the detailed description of the disclosure, when considered in conjunction with the enclosed drawings.

DETAILED DESCRIPTION

Exemplary embodiments of the present disclosure provide a safe and movable electrical connection between the movable electrical contact of a circuit-breaker interrupter and its connection support of the insulating housing or which is suitable for high nominal currents.

According to an exemplary embodiment of the present disclosure the critical second end of the flexible conductor which is used for attaching the electrical conductor to the movable low electrical contact is provided with an inside thread which is screwed on an outside thread arranged on the distal end section of the movable lower electrical contact.

Due to the special mechanical connection of the flexible conductor on the electrical contact side, it can be used for high nominal currents in the same way as treated parts like tubes, or other suitable components as desired. Therefore, the flexible conductor should be relatively thick on the end side which is provided with the inside thread.

An inside thread can be provided at the front side of the distal end of the movable lower electrical contact in order to connect a pushrod which is a part of a jackshaft arrangement operated by an actuator for axially moving the lower electrical contact of the vacuum interrupter. By means of the inside thread on the lower electrical contact the pushrod is mountable in an easy manner and it is possible to adjust the operating hub of the movable lower electrical contact by screwing in or out the pushrod in relation to the movable lower electrical contact.

According to another exemplary embodiment of the present disclosure a screw-nut for securing the flexible conductor to the movable electrical contact is additionally screwed on the outside thread of the movable electrical contact. Instead of a screw-nut it is also possible to use a washer for securing the flexible conductor on the movable electrical contact. In case of a washer it is arranged between the distal end of the movable lower electrical contact and the push rod put-on the outside thread of the push rod for screwing the pushrod into the inside thread of the movable lower electrical contact. Of course, the inside thread can also be arranged on the side of the pushrod.

According to an exemplary embodiment disclosed herein the pushrod is axially attached to the movable lower electrical contact via a threaded stud section of the pushrod which is screwed into the inside thread of the movable lower electrical contact.

According to another exemplary embodiment of the present disclosure the first end of the flexible conductor which corresponds to a support plate in the insulating housing is provided with at least one through hole. Corresponding screws are used for connecting the first end of the flexible conductor to fasting element via the said through holes.

The flexible electrical conductor includes copper material in the form of a non-woven fabric, such as fleece or a fiber material.

Figure 1:
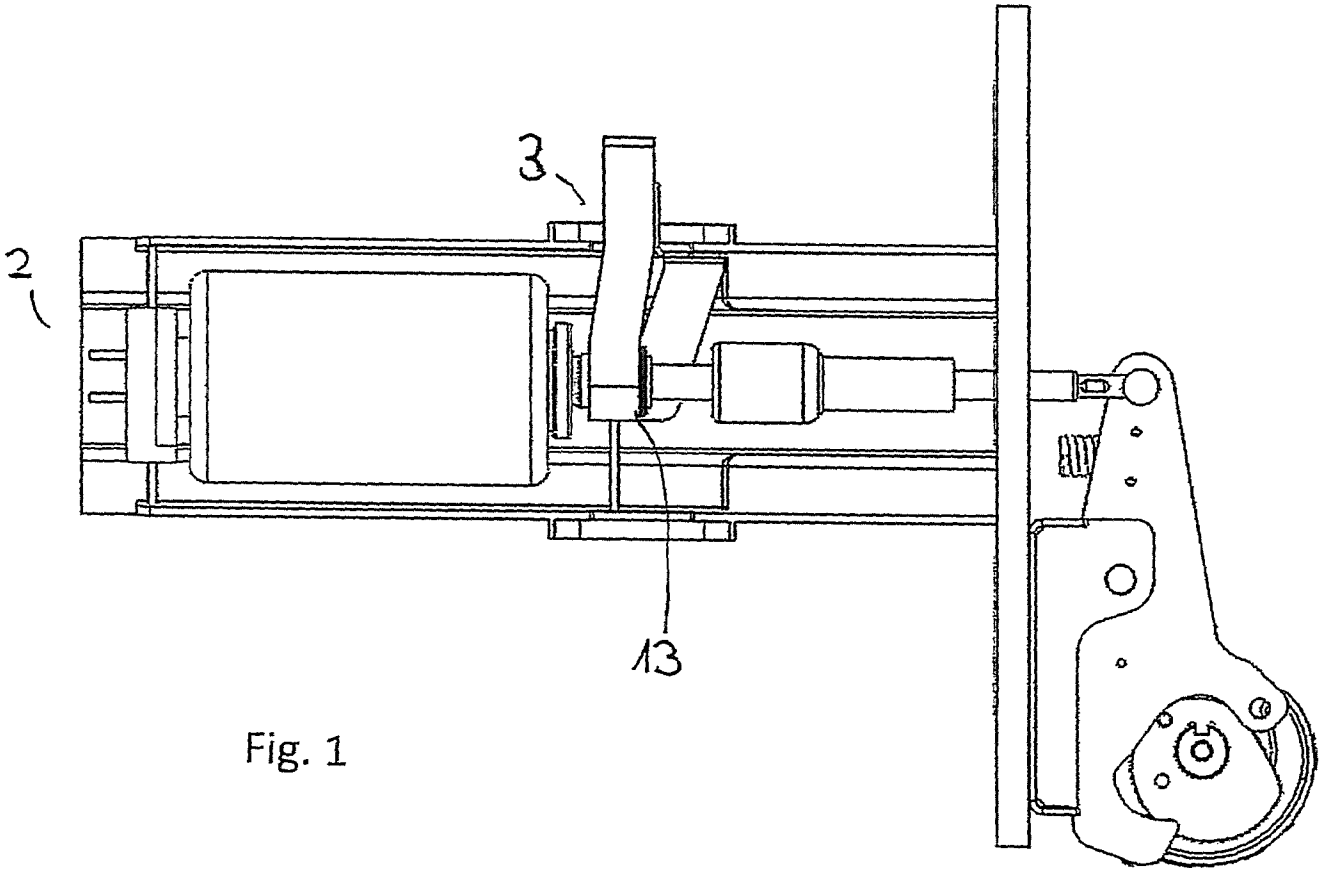
FIG. 1 is a side view of a medium voltage switchgear according to an exemplary embodiment of the disclosure.
Figure 2:
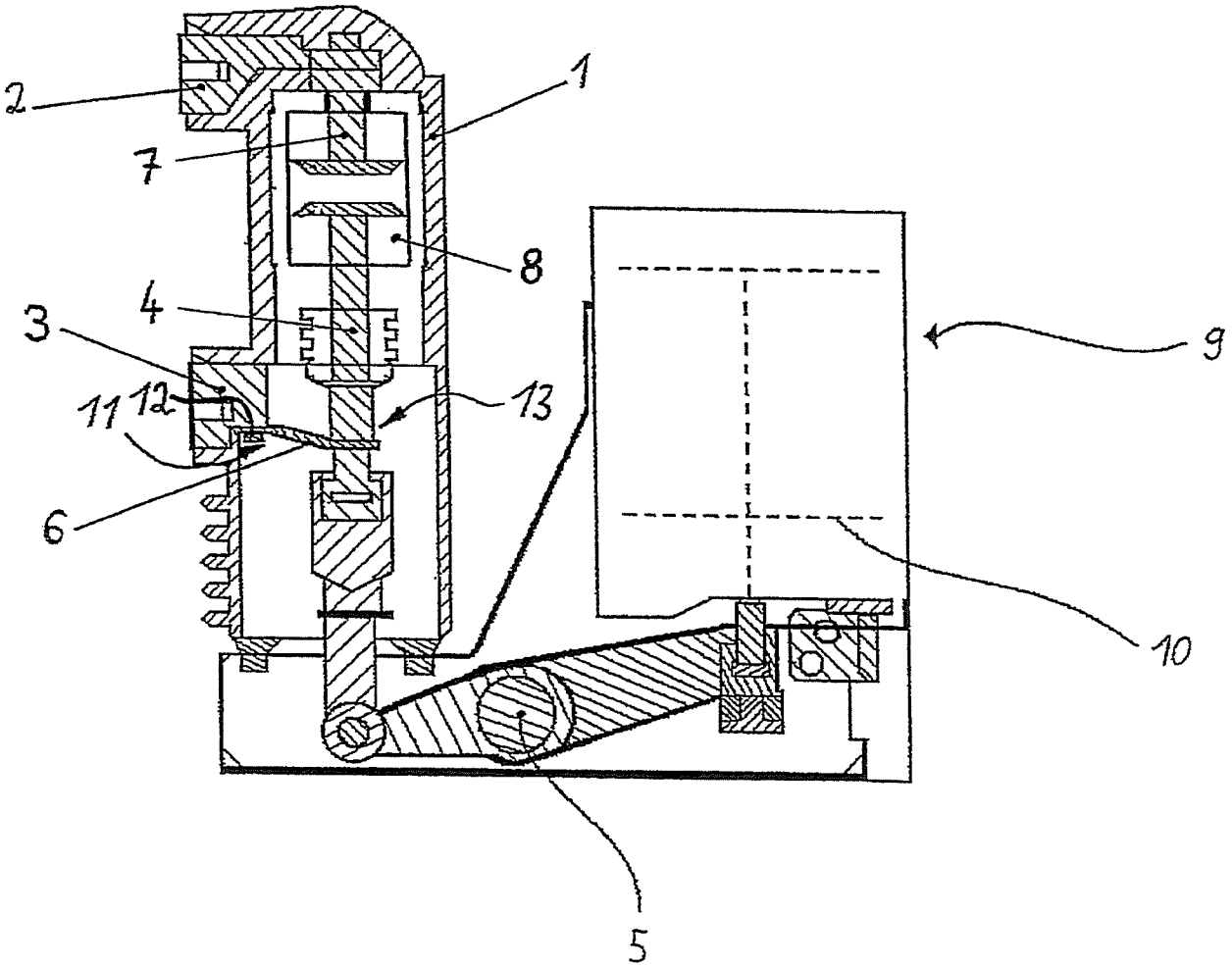
FIG. 2 is a side view of a medium-voltage circuit-breaker arrangement operated by a single magnetic actuator via a jackshaft arrangement according to an exemplary embodiment of the disclosure.

FIG. 1 is a side view of a medium voltage switchgear according to an exemplary embodiment of the disclosure. FIG. 2 is a side view of a medium-voltage circuit-breaker arrangement operated by a single magnetic actuator via a jackshaft arrangement according to an exemplary embodiment of the disclosure. As shown in FIG. 1, the medium-voltage circuit-breaker has an insulating housing for the use of an assembled pole, with an upper electrical terminal 2 and at the lower point a support or support plate for the electrical connection.

The exemplary embodiment of the present disclosure can therefore be used for both applications, in assembled pole parts and in embedded pole parts as well.

The medium-voltage circuit-breaker shown in FIG. 2 includes an insulating housing 1 with an embedded upper electrical terminal 2 and a lower electrical terminal 3 forming an electrical switch for medium-voltage circuit.

Therefore, the upper electrical terminal 2 is connected to a corresponding fixed upper electrical contact 7 which is stationary mounted (e.g., mounted at a fixed position) in a vacuum interrupter insert 8. The corresponding lower electrical contact 4 is movable mounted (e.g., movable about a mounting position) in relation to the vacuum interrupter insert 8.

The lower electrical terminal 3 is connected to a corresponding lower electrical contact 4, which is axially movable (e.g., movable about an axis) arranged in relation to the insulation housing 1. The lower electrical contact 4 is movable between a closed and opened switching position via a jackshaft arrangement 5.

A flexible conductor 6 of copper material is provided in order to electrically connect the lower electrical terminal 3 with the lower electrical contact 4. The jackshaft arrangement 5 internally couples the mechanical energy of a bistable magnet actuator 9 to the insulating housing 1 of the vacuum interrupter insert 8. The magnetic actuator 9 consists of a bistable magnetic arrangement for switching of an armature 10 to the relative position as effected by magnetic fields generated by an—not shown—electrical magnet as well as a permanent magnet arrangement.

The insulation housing 1 supports and houses the vacuum interrupter insert 8 including the two corresponding electrical switching contacts 4 and 7 which are switchable under vacuum atmosphere. The electrical switching contacts 4 and 7 of the vacuum interrupter insert 8 are electrically connected to the upper electrical terminal 2 and the lower electrical terminal 3 respectively as described above. On the side of the lower electrical terminal 3 a first end 11 of the flexible conductor 6 is attached to the lower electrical terminal 3 by at least one corresponding screw 12.

Figure 3:
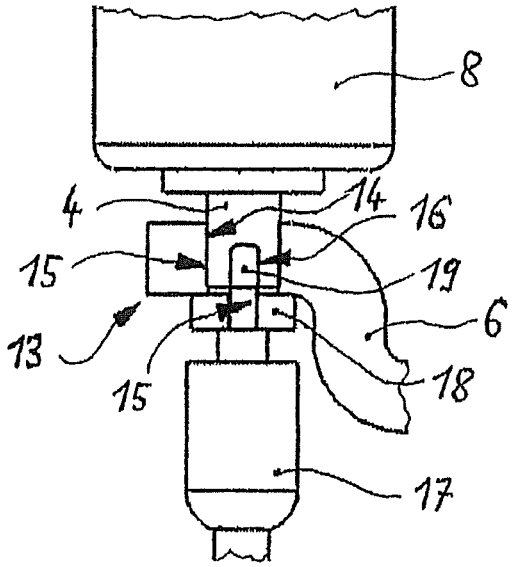
FIG. 3 is a detailed view of an electrical junction between the flexible conductor and the movable lower electrical contact of the interrupter according to an exemplary embodiment of the disclosure.

FIG. 3 is a detailed view of an electrical junction between the flexible conductor and the movable lower electrical contact of the interrupter according to an exemplary embodiment of the disclosure. As shown in FIG. 3, the second end 13 of the flexible conductor 6 includes an inside thread 14 which is screwed on an outside thread 15 arranged on the distal end of the movable lower electrical contact 4. An inside thread 16 is provided on the front side on the distal end of the movable lower electrical contact 4. A pushrod 17 which is a part of the—not shown—jackshaft arrangement is screwed in the inside thread 16 of the movable lower electrical contact 4 in order to provide a mechanical connection of both parts for axially moving the movable lower electrical contact 4.

For securing the flexible conductor 6 on the movable electrical contact 4 a washer or screw-nut 18 is arranged between the distal end of the movable electrical contact 4 and the pushrod 17. The washer or screw-nut 18 is screwed on a threaded stud section 19 of the pushrod 17. Thus, the pushrod 17 is axially attached (e.g., attached about an axis) to the movable lower electrical contact 4 via a threaded stud section 19 which is screwed in the inside thread 16 of the movable lower electrical contact 4.

Figure 4:
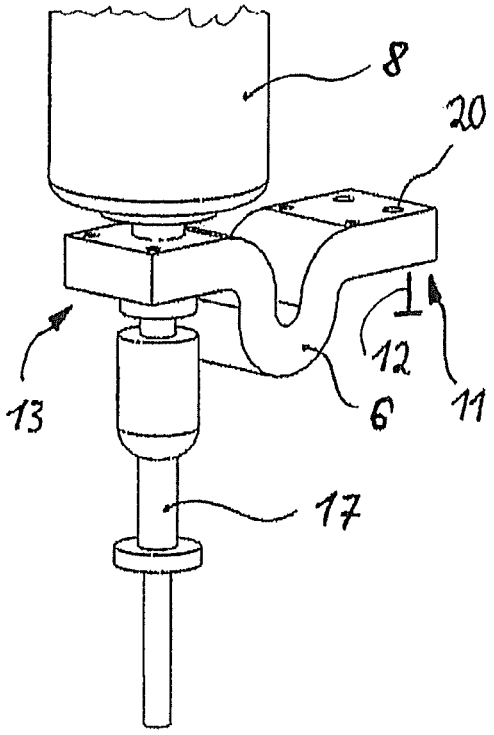
FIG. 4 is a perspective view of the pole part of the medium-voltage circuit-breaker according to FIG. 1 in the section of the lower electrical terminal according to an exemplary embodiment of the disclosure.

FIG. 4 is a perspective view of the pole part of the medium-voltage circuit-breaker according to FIG. 1 in the section of the lower electrical terminal according to an exemplary embodiment of the disclosure. As shown in FIG. 4, at the first end 11 of the flexible conductor at least one through hole 20 is provided for connecting the first end 11 of the flexible conductor 6 by corresponding screws 12 (schematically) to the—not shown—lower electrical terminal 3.

The disclosure is not limited by the preferred embodiment as described above which is presented as an example only but can be modified in various ways within the scope of protection defined by the patent claims. For example, a washer or screw-nut 18 can be used for securing the flexible conductor 6 on the movable lower electrical contact 4.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SIGNS

1 insulating housing
2 upper electrical terminal
3 support plate
4 lower electrical contact
5 jackshaft arrangement
6 flexible conductor
7 upper electrical contact
8 vacuum interrupter insert
9 magnetic actuator
10 armature
11 first end
12 screw
13 second end
14 inside thread
15 outside thread
16 inside thread
17 pushrod
18 washer
19 threaded stud section
20 through hole

What is claimed is:

1. A pole part of a circuit-breaker arrangement, comprising:

an insulation housing for accommodating a vacuum interrupter having a pair of corresponding electrical switching contacts, wherein a fixed upper electrical contact is connected to an upper electrical terminal molded or assembled in the insulation housing and a movable lower electrical contact is connected to an electrical contact element of the insulation housing via a flexible conductor including a first end for attaching the flexible conductor to the insulation housing and a second end for attaching the flexible conductor to the movable lower electrical contact, wherein the second end of the flexible conductor has an inside thread which is screwed to an outside thread arranged on a distal end of the movable lower electrical contact, and wherein on the distal end the movable lower electrical contact has an inside thread that receives a threaded stud; and a screw-nut for securing the flexible conductor on the movable lower electrical contact, wherein the screw nut is screwed on the thread of the threaded stud and is arranged between the distal end of the movable lower electrical contact and a pushrod, the pushrod being axially attached to the movable lower electrical contact via the threaded stud which is screwed in the inside thread of the movable lower electrical contact.

2. The pole part according to claim 1, wherein the first end of the flexible conductor is provided with at least one through hole for connecting the first end of the flexible conductor by corresponding screws to insulation housing by a support plate.

3. The pole part according to claim 1, wherein the flexible electrical conductor consists of copper material in the form of a fleece or a fiber material.

* * * * *